US005090882A

United States Patent [19]

Serizawa et al.

[11] Patent Number: 5,090,882

[45] Date of Patent: Feb. 25, 1992

[54] ROTARY FLUID MACHINE HAVING HOLLOW VANES AND REFRIGERATION APPARATUS INCORPORATING THE ROTARY FLUID MACHINE

[75] Inventors: Yukio Serizawa; Koichi Sekiguchi; Yasuhiro Oshima, all of Tochigi; Tadashi Iizuka, Ashikaga, all of Japan

[73] Assignee: Hitachi, Ltd., Tokyo, Japan

[21] Appl. No.: 557,787

[22] Filed: Jul. 26, 1990

[30] Foreign Application Priority Data

Aug. 4, 1989 [JP] Japan ..... 1-201237

[51] Int. Cl.[5] ..... F04C 18/356; F04C 29/00

[52] U.S. Cl. ..... 418/56; 418/63; 418/152; 418/178; 418/179

[58] Field of Search ..... 418/56, 63–67, 418/152, 178, 179, 243–251

[56] References Cited

U.S. PATENT DOCUMENTS 4,944,663 7/1990 Iizuka et al. ..... 418/178

FOREIGN PATENT DOCUMENTS 54-56206 10/1979 Japan ..... 418/152
60-237190 11/1985 Japan .
62-32293 2/1987 Japan ..... 418/178
64-35091 2/1989 Japan .

*Primary Examiner*—John J. Vrablik
*Attorney, Agent, or Firm*—Antonelli, Terry & Stout & Kraus

[57] ABSTRACT

A rotary compressor has a plate-like hollow vane disposed in sliding contact with a rotary piston. The vane has an internal cavity formed by a plurality of bores each having a substantially rectangular cross-section. The corners of each bore are each formed by a curved concave surface of a radius of curvature which is greater than the thicknesses of the outer walls of the vane. The major side surfaces of the vane are in slidable contact with opposing walls of a vane slot and have surface layers each formed of an oxide film consisting mainly of tri-iron tetraoxide ($Fe_3O_4$). The film is finished by smoothing processing, thus attaining a smaller friction between the vane major side surfaces and the vane slot walls and suppressing local wear of the vane slot walls.

11 Claims, 9 Drawing Sheets

| TYPE OF TREATMENT | VANE SLOT WALL WEAR δ | VANE BREAKAGE |
|---|---|---|
| SOFT GAS NITRIDING | GOOD | BROKEN |
| ACID NITRIDING | EXCELLENT | BROKEN |
| SULFUR NITRIDING | EXCELLENT | BROKEN |
| STEAM TREATMENT | GOOD | NOT BROKEN |
| STEAM TREATMENT WITH SURFACE SMOOTHING | EXCELLENT | NOT BROKEN |
| NO TREATMENT | NO GOOD | NOT BROKEN |

ROTARY FLUID MACHINE HAVING HOLLOW VANES AND REFRIGERATION APPARATUS INCORPORATING THE ROTARY FLUID MACHINE

BACKGROUND OF THE INVENTION

The present invention relates to a rotary fluid machine having at least one hollow vane and a refrigeration apparatus incorporating such a rotary fluid machine. More specifically, the present invention is concerned with an improvement in a rotary fluid machine such as a rotary compressor used in a refrigeration system of an air conditioner, a refrigerator, a dehumidifier or the like, and also with a refrigeration apparatus incorporating such an improved rotary fluid machine.

DESCRIPTION OF THE RELATED ART

Rotary compressors, as a kind of rotary fluid machines with vanes, are broadly used in refrigeration systems of air conditioners, electric household refrigerators, dehumidifiers and so forth.

In recent years, hollow vanes having reduced weights and, hence, reduced inertial masses have been developed to cope with a current demand for higher operation speeds of refrigeration systems which essentially require higher operation speed of rotary compressors.

For example, Japanese Unexamined Patent Publication No. 60-237190 discloses a rotary compressor incorporating a hollow vane formed by powder metallurgical process, cold forging, hot forging or machining. Japanese Unexamined Patent Publication No. 64-35091 discloses a hollow vane which is produced by injection molding of a water-atomized material powder having a composition of a high-speed tool steel and which has an internal cavity opening in a non-sliding surface of the vane, wherein the surfaces of the vane contactable with the rotary and the cylinder block are treated by sulfurnitriding for attaining a lower coefficient of friction.

These known vanes for rotary compressor, however, suffer from disadvantages which will be described hereinafter with specific reference to FIGS. 3 to 10.

Figure 3:
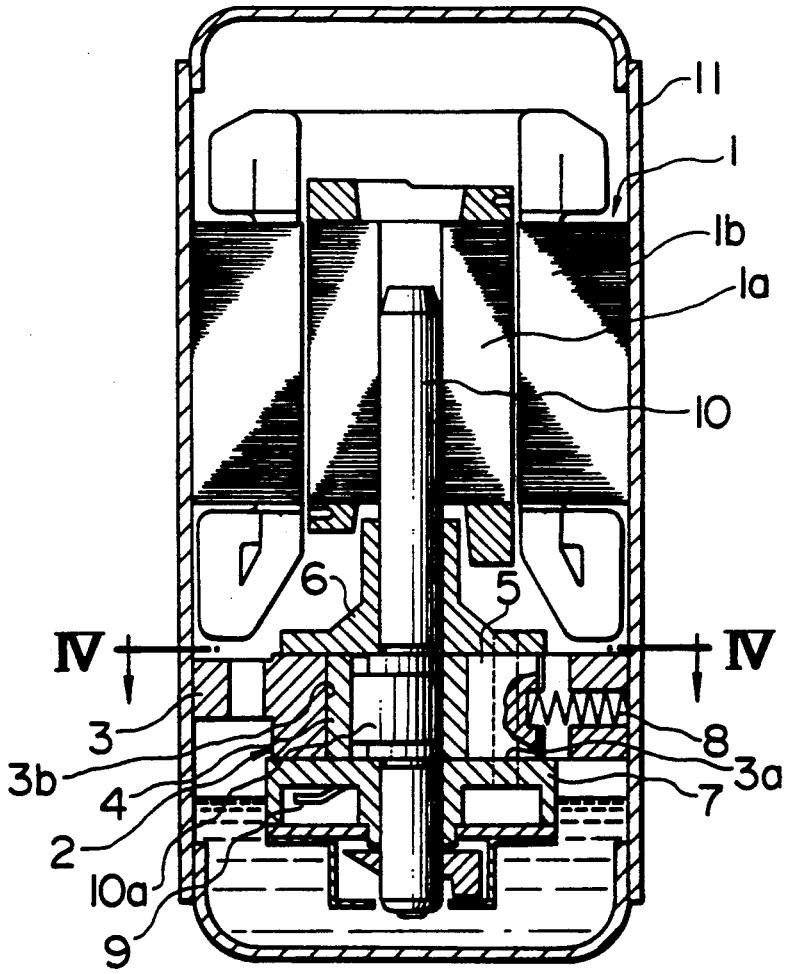
FIG. 3 PRIOR ART
FIG. 3 is a vertical sectional view of a conventional rotary compressor.
Figure 4:
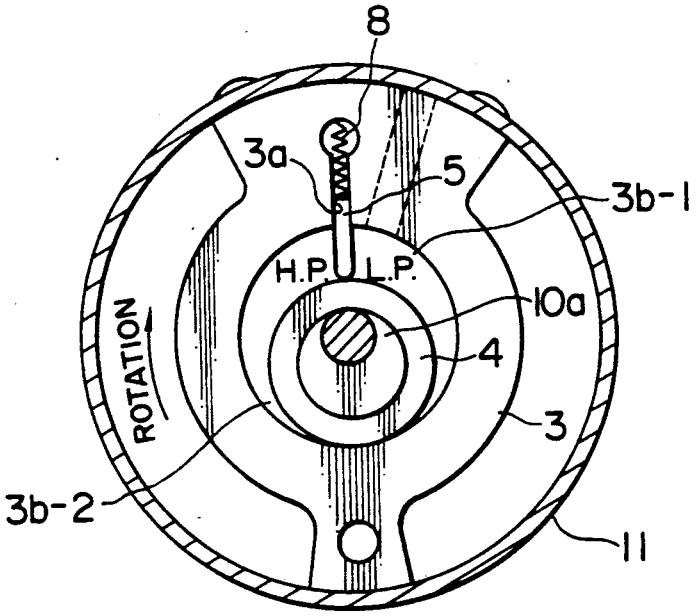
FIG. 4 PRIOR ART
FIG. 4 is a cross-sectional view taken along the line IV—IV in FIG. 3.

Referring first to FIGS. 3 and 4, an ordinary rotary compressor has a hermetic housing 11 which houses an electric motor unit 1 including a rotor 1*a* and a stator 1*b* and a compressor mechanism 2 having a rotary shaft 10 which is integral with the shaft of the rotor 1*a* of the motor unit 1*a*.

The compressor mechanism 2 has a cylinder block 3 fixed to the hermetic housing 11 and provided with a vane slot 3*a*, a roller 4 rotatably carried by a crank portion 10*a* of the rotary shaft 10 and capable of eccentrically rotating within a cylinder bore 3*b* formed in the cylinder block 3, a vane 5 received in the vane slot 3*a* and contacting at its one end with the roller 4 and resiliently biased at its other end by a spring 8 so as to reciprocate within the vane slot 3*a* in accordance with the eccentric rotation of the roller 4 while dividing the space inside the cylinder bore 3*b* into a low-pressure chamber 3b-1 (suction-side chamber) and a high-pressure chamber (discharge-side chamber), main and sub-bearings 6 and 7 which close both axial ends of the cylinder bore 3*b* and which rotatably support the rotary shaft 10, and a discharge valve 9 provided on the sub-bearing 7.

The known vane 5 disclosed in Japanese Unexamined Patent Publication No. 64-35091 has, as shown in FIG. 7, rectangular bores 5*a'* which form internal cavities opening in the non-sliding surface of the vane. Previously, no specific consideration has been given to the corners of the rectangles so that a fracture of the vane tends to occur as at 5a-1 in FIG. 8 due to stress concentration to the corners and due to thinning of the vane wall as a result of provision of the internal cavities.

Figure 5:
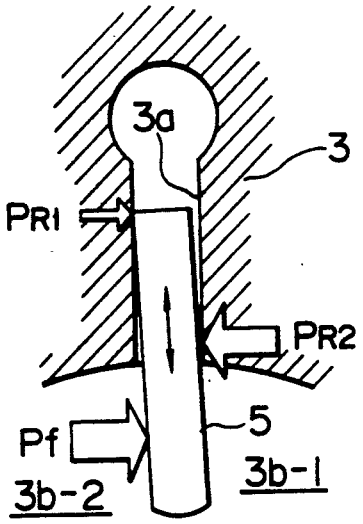
FIG. 5 PRIOR ART
FIG. 5 is an enlarged view of a vane slot and a vane, illustrating the forces acting on the vane.
Figure 6:
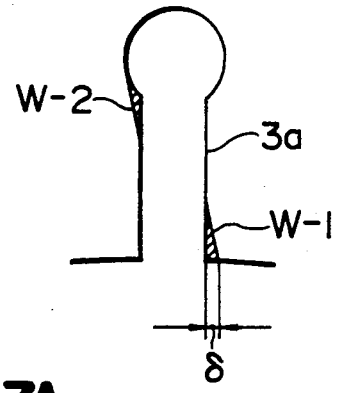
FIG. 6 PRIOR ART
FIG. 6 is an illustration showing the wear of the vane slot.

In general, the vane 5 is inclined within the vane slot 3*a* due to the pressure differential Pf between the low-pressure chamber and the high-pressure chamber to non-uniformly contact the walls of the vane slot 3*a*, as shown in FIG. 5. More specifically, the vane 5 is inclined such that reactional forces $P_{R1}$ and $P_{R2}$ are generated at the outer end, i.e., the end, adjacent the spring (omitted from FIG. 5), of one side surface of the vane 5 and the portion of the other side surface of the vane 5 contacted by the edge of the vane slot 3a adjacent the low-pressure chamber 3b-1. Thus, the vane 5 reciprocates within the vane slot 3a while the vane is inclined in a manner shown in FIG. 5. Consequently, the walls of the vane slot 3a are locally worn as at W-1 and W-2 in an amount $\delta$ as hatched in FIG. 6.

The hollow vane disclosed in Japanese Unexamined Patent Publication No. 64-35001, which has surface regions hardened by sulfur-nitriding treatment, is liable to be broken due to embrittlement caused by nitrogen penetrating into the thin vane walls from both surfaces thereof.

Figure 9:
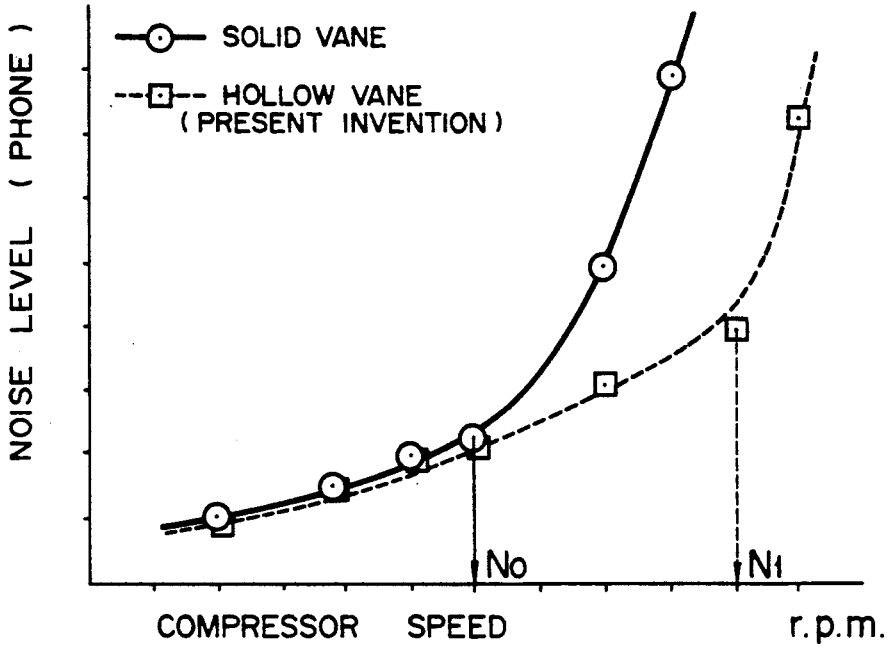
FIG. 9 is a graph showing the relationship between the level of noise generated in a rotary compressor and the operation speed of the rotary compressor.

Another problem encountered with this type of rotary fluid machine is generation of noise which is serious particularly when the machine operates at a high speed, as will be understood from the following description with reference to FIG. 9 which is a graph showing the relationship between the noise level (phone) and the operation speed (r.p.m.) of a rotary compressor of the kind described. In FIG. 9, the solid line represents the noise characteristic as observed when a conventional solid vane was used, while the broken-line curve shows the noise level produced when the compressor employs a hollow vane in accordance with the present invention. The term "solid vane" means a vane which is devoid of internal cavity and, hence, has a large mass, produced by cutting or other machining from a sheet material. In FIG. 9, $N_0$ and $N_1$ represent critical speeds at which abnormal noise generations start to occur. The mechanism of generation of noise in this type of compressor will be described later.

Thus, the conventional rotary compressor of the type described and, particularly the compressor with a solid vane used therein, has suffered from a problem that the noise level is drastically raised, when the operation speed is increased, due to collision between the vane and the roller caused as a result of a change in the direction of the inertia force of the mass of the vane.

SUMMARY OF THE INVENTION

Accordingly, an object of the present invention is to provide a rotary fluid machine such as a rotary compressor with a hollow vane incorporated therein, which is improved to diminish fracture of the hollow vane and local wear of the vane slot, thus offering a higher degree of reliability of the rotary fluid machine of this type.

Another object of the present invention is to provide a refrigeration apparatus including a rotary compressor with a hollow vane and a high-speed operation control means, such as an air conditioner, electric household refrigerator, dehumidifier or the like, wherein the critical speed at which the generation of noise due to collision between the vane and the roller starts to occur is increased so as to enable the rotary compressor to operate at an increased speed and to have a compact construction, while reducing the level of noise generated in the refrigeration apparatus.

To this end, the present invention in its first aspect provides a rotary fluid machine comprising a cylinder block defining a cylinder bore therein, a rotary piston rotatably disposed in the cylinder bore and a plate-like hollow vane dividing the space in the cylinder bore into a low-pressure chamber and a high-pressure chamber. The vane has formed therein at least one cavity of a shape having corners. Each of the corners comprises curved concave surface of the radius of curvature greater than the thicknesses of the outer walls of the vane.

According to a second aspect of the invention, there is provided a rotary fluid machine comprising a cylinder block defining a cylinder bore therein, a rotary piston rotatably disposed in the cylinder bore and a plate-like hollow vane dividing the space in the cylinder bore into a low-pressure chamber and a high-pressure chamber. The vane has formed therein least one cavity of a shape having corners. Each of the corners comprises a curved concave surface of a radius of curvature greater than the thicknesses of the outer walls of the vane. The cylinder block has formed therein a vane slot slidably receiving the vane. The vane has two major side surfaces slidable on the opposing surfaces of the vane slot. Each of the major side surfaces of the vane has a surface layer formed of an oxide film consisting mainly of tri-iron tetraoxide ($Fe_3O_4$) and finished by smoothing processing.

The invention in its third aspect provides a refrigeration apparatus comprising an electric motor and compressing means driven by the electric motor. The compressing mean includes a cylinder block defining a cylinder, bore therein, a rotary piston rotatably disposed in the cylinder bore and a plate-like hollow vane dividing the space in the cylinder bore into a low-pressure chamber and a high-pressure chamber. The vane has formed therein least one cavity of a shape having corners each comprising a curved concave surface of a radius of curvature greater than the thicknesses of the outer walls of the vane.

According to the first and the third aspects of the invention, the corners of the cavity of the hollow vane are rounded at a radius of curvature which is greater than the thickness of the outer wall of the vane, so that concentration of stress to such corners is avoided to prevent fracture of the hollow vane attributable to such stress concentration.

According to the second aspect of the present invention, the corners of the cavity are rounded at radius of curvature mentioned above and, in addition, an oxide film consisting mainly of tri-iron tetraoxide ($Fe_3O_4$) is formed on the surfaces of the vane. The oxide film has a smoothened by a finish processing to improve sliding characteristic of the vane while suppressing wear of the vane slot.

A description will now be made of an approach to a reduction in the noise in this type of rotary fluid machine and in a refrigeration apparatus incorporating such a machine, with reference to FIGS. 9 to 12.

The mechanism of generation of noise will be described first with reference to FIG. 10.

Figure 10:
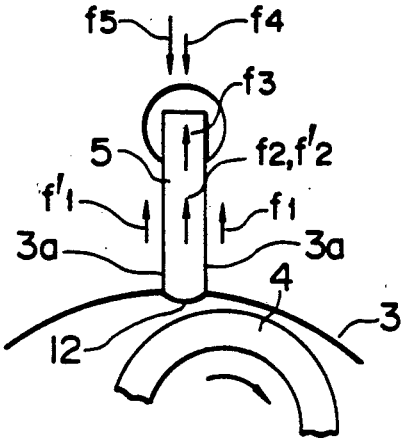
FIG. 10 PRIOR ART
FIG. 10 is a schematic elevational view of a vane illustrative of the mechanism of generation of extraordinary noise in the rotary compressor.

In FIG. 10, different arrows indicate different force components acting on an ordinary vane when the vane is at its upper or outer stroke end. These force components are as follows:

$f_1$, $f'_1$: forces of friction between vane 5 and slot 3a;

$f_2$, $f'_2$: forces of friction between the vane 5 and the main and sub-bearings 6 and 7;

$f_3$: inertia force acting on the vane 5;

$f_4$: force generated by the spring 8; and $f_5$: force generated by gas pressure differential.

The inertial force $f_3$ acting on the vane 5 is given by the following formula:

$$f_3 = \left\{ e\omega^2\cos\omega t + \frac{e^2\omega^2\cos 2\omega t}{\sqrt{(R+Rv)^2-(e\sin\omega t)^2}} + \frac{(e^2\omega\sin 2\omega t)^2}{4[\sqrt{(R+Rv)^2-(e\sin\omega t)^2}]^3} \right. \cdot m$$

where, e represents the amount of eccentricity of the rotary shaft 10, $\omega$ represents the rotation angular velocity, t represents time, R represents radius of the roller, Rv represents the radius of the end of the vane 5 contacting the roller 4, and m represents the mass of the vane 5.

The condition of the balance between the force components acting on the vane 5 in a direction to press the vane 5 against the roller 4 and the force components acting on the vane 5 in the counter direction is expressed by the following formula (1):

$$f_4+f_5 \leqq f_1+f'_1+f_2+f'_2+f_3 \quad (1)$$

The formula (1) can be transformed into more simple expressions as follows:

$$f_{4min} \leqq f_{3max}(\omega)-C \quad (2)$$

$$C=f_{1u}+f'_{1u}+f_{2u}+f'_{2u}-f_{5u} \quad (3)$$

The formulae (2) and (3) represent the states of the forces acting on the vane 5 when the vane is in the vicinity of its upper or outer stroke end.

In formula (2) above, $f_{4min}$ represents the minimum necessary force of the spring 8 when the vane is in the vicinity of the upper or outer stroke end, while $f_{3max}$ represents the force of inertia of the vane when the vane is in the vicinity of the upper or outer stroke end, the force of inertia varying according to the rotation angular velocity $\omega$. In formula (3) above, $f_{1u}$, $f'_{1u}$, $f_{2u}$, $f'_{2u}$ and $f_{5u}$ respectively represent the values of the force components $f_1$, $f'_1$, $f_2$, $f'_2$ and $f_5$ obtained when the vane is near its upper stroke end. Symbol C represents a constant which does not change according to the angular velocity $\omega$.

When the minimum required force $f_{4min}$ of the spring 8 does not meet the condition of the formula (2), a clearance 12 is caused between the vane 5 and the roller 4, as shown in FIG. 10, so that the vane 5 collides with the roller 4 to generate a noise during movement of the roller towards the lower stroke end.

The inertial force acting on the vane increases in proportion to the square of the operation speed of the rotary compressor. Thus, the inertial force and, hence, the gap between the vane 5 and the roller 4 are drastically increased to raise the noise level when a certain rotation speed is exceeded.

Figure 11:
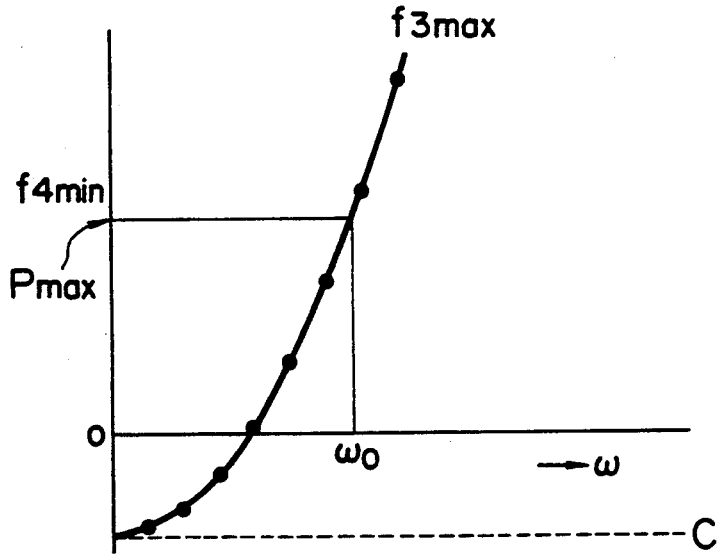
FIG. 11 is a graph showing the level of the force to be exerted by a vane spring.

FIG. 11 is a graph showing the condition of the formula (2). In FIG. 11, the axis of abscissa represents the rotation angular velocity ($\omega$), while the axis of ordinate, starting from the origin O, represents the minimum necessary force $f_{4min}$ of the spring 8 when the vane is in the vicinity of the upper stroke end. The change in the inertial force $f_{3max}$ of the vane in the vicinity of the upper stroke end is plotted.

It will be seen that the inertial force $f_{3max}$ changes substantially in proportion to $\omega^2$. In FIG. 11, the level C represents the value of the constant C in the formula (2) which is constant regardless of the rotation angular velocity $\omega$.

A level $p_{max}$ appearing in FIG. 11 indicates the design limit level for the design of the spring 8 which is determined in accordance with the limitation in the space related to the designs of the vane 5 and the vane slot 3a in the cylinder block 3. The angular velocity $\omega_0$ at which the force components $f_{3max}$ and $f_{4max}$ balanced each other is determined from the design limit $p_{max}$. This rotation angular velocity $\omega_0$ corresponds to the aforementioned critical speed $N_0$ at which generation of abnormal noise starts to occur in a compressor employing the prior art solid vane discussed in connection with FIG. 9. Namely, when the rotation angular velocity $\omega$ exceeds the velocity $\omega_0$, the condition of the formula (2) can no longer be met, so that the vane 5 collides with the roller 4 to generate noise.

Under this circumstance, the present inventors considered that a higher operation speed with reduced noise generation would be possible by designing such that the critical speed at which generation of abnormal noise starts to occur is shifted to a higher-speed side as shown by the broken-line curve in FIG. 9, and succeeded in shifting the critical rotation speed from $N_0$ to $N_1$ by virtue of the use of a hollow vane. This enables the compressor to operate at a higher speed and, hence, to have a reduced displacement (which is, as will be explained later, the amount of fluid displaced per each compression operation, thus contributing to a reduction in the size and weight of the rotary compressor. It is therefore possible to reduce the level of the noise during operation of a refrigeration apparatus such as an air conditioner, by employing the rotary compressor of the invention described above and operating this compressor at a power frequency higher than the commercial power frequency through an inverter.

Figure 12:
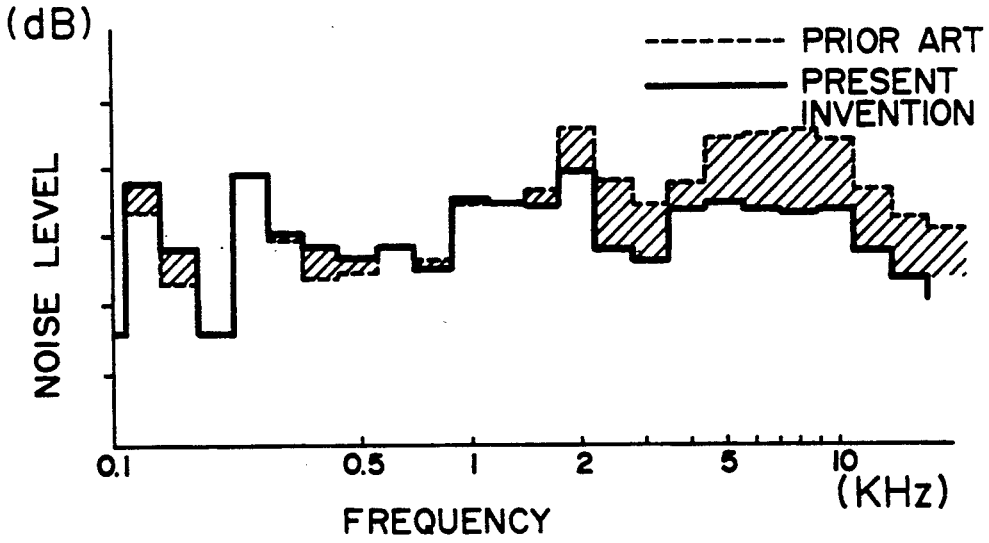
FIG. 12 is a graph showing levels of noise components of different frequencies.

In FIG. 12, the solid line indicates the frequency distribution of the noise level, i.e., the levels of noise components of different frequencies, generated by a rotary compressor of the invention, the broken line indicates the frequency distribution of noise level observed in a conventional rotary compressor.

DESCRIPTION OF THE PREFERRED EMBODIMENTS

Preferred embodiments of the present invention will be described with reference to FIGS. 1, 2 and 13 through 16 as well as other figures referred to in the foregoing description.

A rotary compressor, as an embodiment of the rotary fluid machine with hollow vane in accordance with the present invention, has a construction substantially the same as that of the known rotary compressor described before in connection with FIGS. 3 and 4, so that the description of the construction of this embodiment is omitted.

Figure 2:
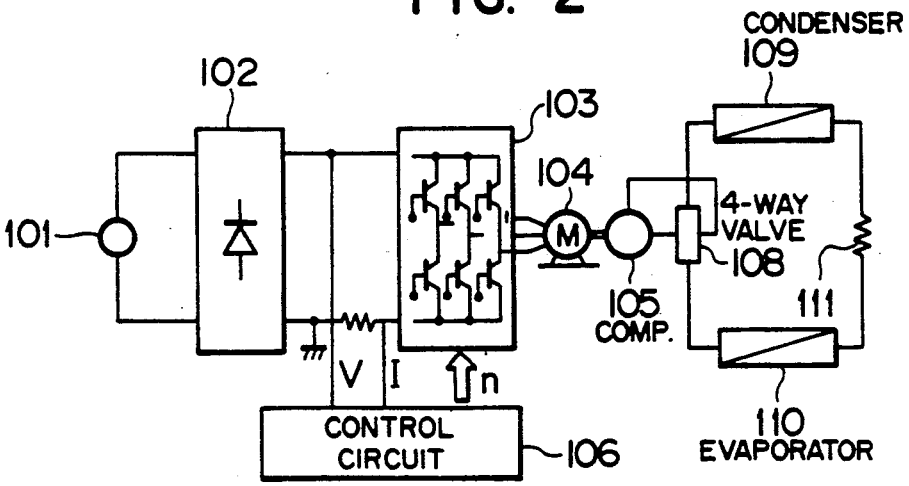
FIG. 2 is a diagram showing the construction of an inverter-controlled air conditioner incorporating a rotary compressor having the hollow vane shown in FIG. 1.

This rotary compressor is incorporated in an inverter-controlled air conditioner shown in FIG. 2.

Referring to FIG. 2, the air conditioner has a converter 102 for converting electrical power supplied by a commercial power supply 101 into a D.C. power of varying voltage, an inverter 103 for converting the D.C. power into an A.C. power, an electric motor 104 the speed of which is variable under the control of the inverter 103, a compressor 105, and a control circuit 106. The motor 104 and the compressor 105 respectively correspond to the motor unit 1 and the compressor mechanism 2 of the rotary compressor shown in FIG. 3. The compressor 105 is incorporated in a refrigeration cycle which includes, in addition to the compressor 105, a four-way valve 108, heat exchangers 109 and 110 serving as a condenser and an evaporator, respectively, a pressure reducer 111 and a refrigerant pipe by which these components are connected.

Figure 1A:
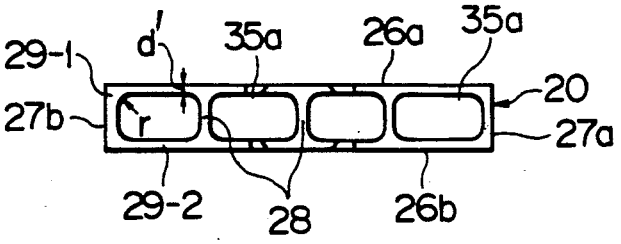
FIGS. 1A, 1B and 1C are a top plan view, a front elevational view and a side elevational view of a hollow vane used in an embodiment of the rotary fluid machine in accordance with the present invention.
Figure 1B:
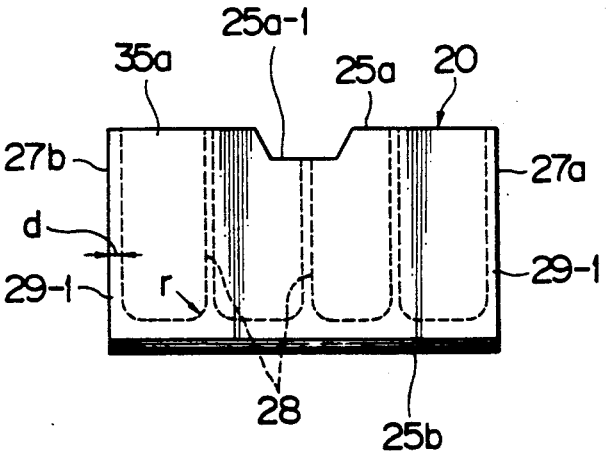
Figure 1C:
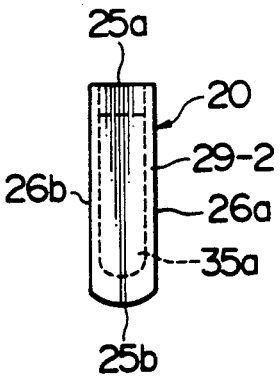

FIGS. 1A to 1C show a hollow vane which is incorporated in the rotary compressor.

The hollow vane 20, which appears to be a plate-like member, has a non-sliding surface 25*a* on which the spring 8 shown in FIG. 3 acts, a sliding surface 25*b* to be disposed in sliding contact with the roller 4 shown in FIG. 3, two major side surfaces 26*a* and 26*b* to be disposed in sliding contact with the side walls or surfaces of the vane slot 3*a* shown in FIG. 5, and two edge surfaces 27*a* and 27*b*. The non-sliding surface 25*a* is provided with a recess 25a-1 for receiving one end of the spring 8. A plurality of bores 35*a* each having a rectangular cross-section are formed within the vane 20 to provide internal cavities of the hollow vane 20. These rectangular bores open only in the non-sliding surface 25*a*. Adjacent rectangular bores 35*a* are partitioned by ribs 28 which interconnects both major side surfaces 26*a* and 26*b* of the vane 20. The central rib 28 is positioned in alignment with the center of the recess 25a-1 so that the spring 8 is supported at its one end by the outer end of this rib 28. Outer walls 29-1 of the vane between the edge surfaces 27*a* and the adjacent rectangular bores 35*a* have a thickness d, while outer walls 29-2 of the vanes between the major side surfaces 26*a* and the rectangular bores 35*a* have a thickness d'. All the corners of all rectangular bores 35*a* are formed by curved concave surfaces each of a radius r of curvature which is greater than the wall thicknesses d and d'.

These curved surfaces serve to reduce the stress concentration factor $\alpha$ and the notch factor $\beta$ close to 1.0, respectively, so as to eliminate concentration of the stress to the corners of the bores.

Figure 7A:
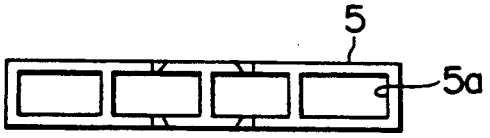
FIG. 7A PRIOR ART
FIGS. 7A, 7B and 7C are a top plan view, a front elevational view and a side elevational view of a known hollow vane.
Figure 7B:
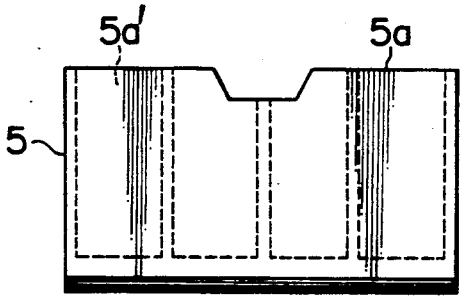
FIG. 7B PRIOR ART
Figure 7C:
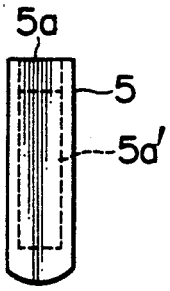
FIG. 7C PRIOR ART
Figure 8:
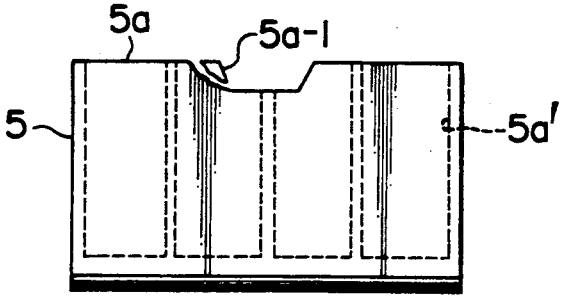
FIG. 8 PRIOR ART
FIG. 8 is a front elevational view of a hollow vane illustrating damage of the vane caused by a durability test.

The stress concentration factor $\alpha$ and the notch factor $\beta$ are respectively given by the following formulae:

$$\alpha = \sigma_{max}/\sigma_0$$

where $\sigma_{max}$ and $\sigma_0$ respectively represent the maximum stress and the nominal stress; and $\beta$ = fatigue limit of flat member/fatigue limit of notched member Thus, the hollow vane shown in FIGS. 1A to 1C which is incorporated in the rotary compressor embodying the present invention, overcomes the problem which has been encountered with conventional hollow vanes 5 of the type shown in FIGS. 7A to 7C, i.e., breakage of the vane due to stress concentration and thinning of the vane wall.

Figures 13, 14:
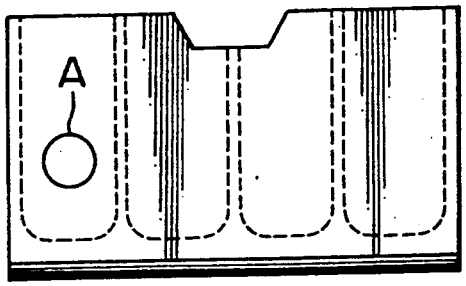
FIG. 13 is a table showing applicability of several types of vane surface treatments for suppressing the wear of the vane slot and breakage of the vane.
FIG. 14 is a front elevational view of the hollow vane shown in FIG. 1 indicating the portion of the vane at which a microscopic photograph showing the metallurgical structure was taken.

In order to determine the optimum surface treatment of the hollow vane 20 shown in FIGS. 1A–1C, various sample vanes were prepared and tested after surface treatments conducted in various ways, with the results being shown in FIG. 13.

As explained before, it is required that the hollow vane 20 does not reduce its strength despite the thinning of the vane wall and suppresses local wear of the side walls of the vane slot 3*a*.

More specifically, outer surfaces of different sample hollow vanes 20 were treated by soft gas nitriding, acid nitriding, sulfur nitriding, steam treatment and steam treatment with surface smoothing processing, respectively. These sample vanes 20, as well as a sample vane 20 which has not been surface-treated, were subjected to a durability test and amounts $\delta$ of wear of the vane slot walls (see FIG. 6) and any fracture of the vanes were exampled.

As will be seen from FIG. 13 showing the test results, the highest performance was exhibited by the sample which was treated by steam treatment with surface smoothing processing.

The process for effecting the steam treatment with surface smoothing processing has the steps of: heating the vane 20 in a saturated steam at about 600° C. to form on its surfaces an oxide film mainly consisting of tri-iron tetraoxide ($Fe_3O_4$); and finishing the steam-treated surfaces by barrel polishing or buff polishing thereby smoothing these surfaces. Details of this treatment are disclosed in co-pending earlier application Ser. No. 07/340,289 filed Apr. 19, 1989, now U.S. Pat. No. 4,944,663, the disclosure therein being incorporated herein by reference.

Figure 15A:
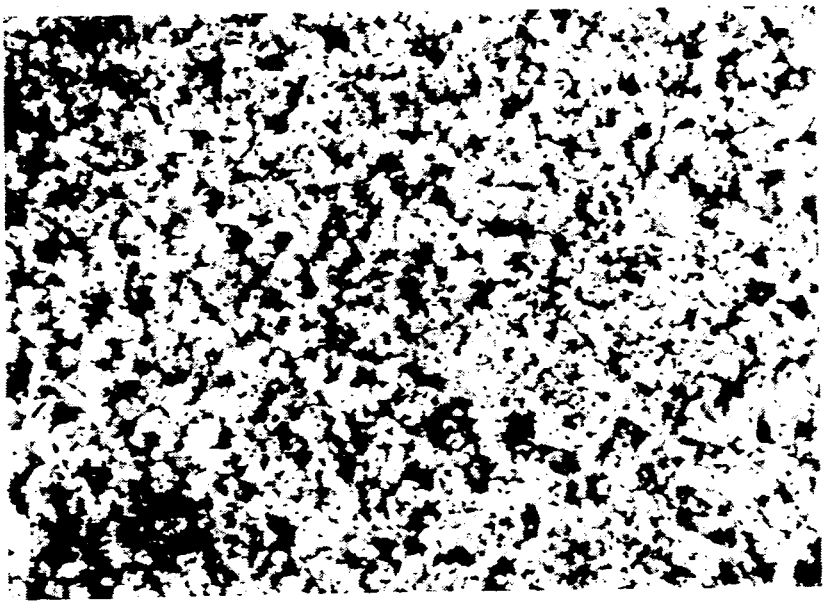
FIG. 15A is a microscopic photograph of the metallurgical structure at the vane surface portion A shown in FIG. 14 taken in a state before a smoothing treatment.
Figure 16A:
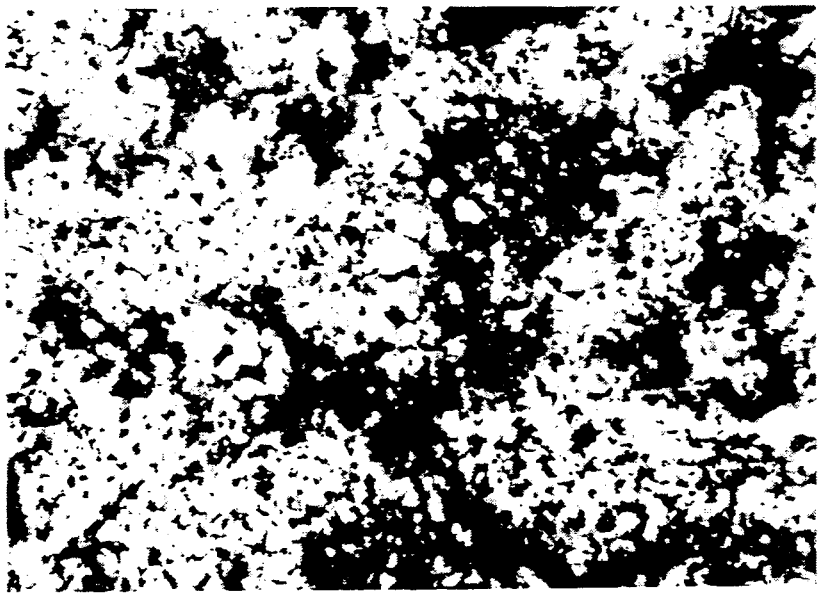
FIG. 16A is a microscopic photograph of the metallurgical structure at the vane surface portion A shown in FIG. 14 taken in a state after a smoothing treatment.
Figure 15B:
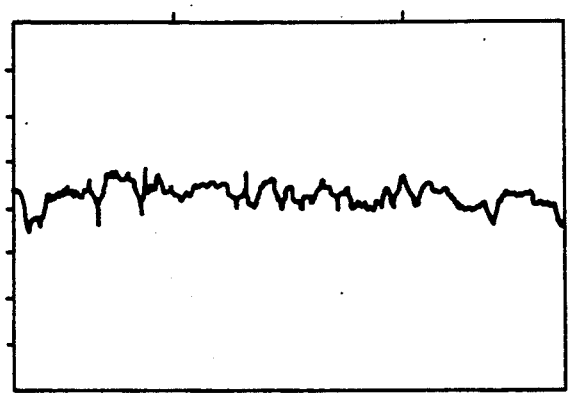
FIG. 15B is an oscilloscope waveform chart showing the roughness of the vane surface shown in FIG. 15A.
Figure 16B:
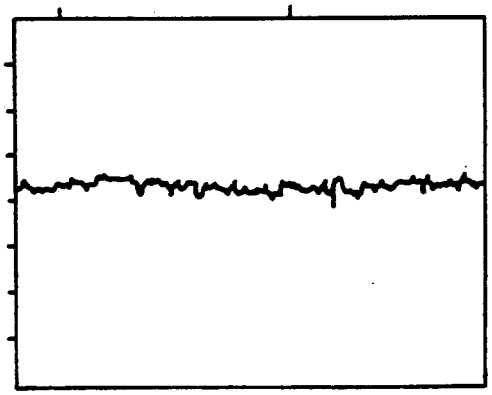
FIG. 16B is an oscilloscope waveform chart showing the roughness of the vane surface shown in FIG. 16A.

FIG. 15A and 15B show, respectively, a microscopic photograph of the metallurgical structure of the vane which has not been subjected to the surface-smoothing processing and an oscilloscope waveform indicating the roughness of the surface of the vane. FIGS. 16A and 16B show, respectively, a microscopic photograph of the metallurgical structure of the vane which has been subjected to the smoothing processing and an oscilloscope waveform indicating the roughness of the surface of this vane. From the comparison between the pairs of FIGS. 15A and 15B and FIGS. 16A and 16B, it will be seen that the vane which has been subjected to the smoothing processing exhibits a smoother surface as a result of removal of minute projections on the surface. The microscopic photographs of FIGS. 15A and 15B were taken on portions of the samples indicated at A in FIG. 14.

This embodiment exhibits an improved characteristic against seizure between the vane slot and the vane by virtue of the film of $Fe_3O_4$ formed by the steam treatment on the surfaces of the vane. In addition, the local wear of the walls of the vane slot is remarkably reduced due to the fact that minute projections on the vane surfaces have been removed as a result of the surface-smoothing processing.

A description will now be made as to suppression of noise in the rotary compressor which is required to assure a quite operation of an air conditioner incorporating the rotary compressor.

The level of noise generated in a rotary compressor incorporating the conventional solid vane varies according to the operation speed of the compressor in a manner shown by the solid-line curve in FIG. 9. For the reason described before, the level of the noise drastically increases when the operation speed has exceeded a certain critical speed represented by $N_0$.

The present inventors have conducted an experiment in which a hollow sample vane having the same construction as the hollow vane 20 shown in FIG. 1 was tested together with a solid sample vane having the same outside dimensions and made of the same material as the hollow sample vane. The mass of the solid vane sample was twice as large as that of the hollow sample vane. When the solid vane sample was used, generation of abnormal noise started at a critical speed $N_0$ of about 7000 r.p.m., whereas, when the hollow sample vane was used, generation of abnormal noise was observed at a critical speed $N_1$ of about 11,000 r.p.m. Thus, the speed range over which the compressor can operate at satisfactorily low level of noise is increased by about 40%.

This means that the displacement of the rotary compressor for the same output can be reduced by about 40%.

The "displacement" is the volume of the fluid displaced by one compression stroke of the compressor and is given by the following formula:

$$V=\frac{1}{4}\pi(D^2-d^2)\,H$$

where, V represents the displacement ($cm^3$/rev.), D represents the diameter of the cylinder bore (cm), d represents the outside diameter of the roller (cm) and H represents the height of the cylinder (cm).

The present inventors have confirmed through an experiment that a rotary compressor which is 118.4 mm in outside diameter, 256 mm in height and 10 kg in weight, with a displacement $V_1$ of 12.5 $cm^3$/rev., can be operated at the noise-generation critical speed $N_1$ of 10300 r.p.m. to produce an output which is same as that produced by a comparison rotary compressor of 139.2 mm in outside diameter, 292 mm in height and 15 kg in weight with a displacement $V_0$ of 19.5 $cm^3$/rev. operable at the noise generation critical speed $N_0$ of 6600 r.p.m. Thus, the size and weight of the rotary compressor can be reduced by about 33%, respectively, due to the reduction in the required displacement from 19.5 $cm^3$/rev. to 12.5 $cm^3$/rev. which is realized by virtue of the shift of the noise generation critical speed from 6600 r.p.m. to 10300 r.p.m.

The described rotary compressor of the invention was incorporated in the air conditioner shown in FIG. 2. The motor 104 was connected to the commercial power supply 101 through the converter 102 and the inverter 103 so that the motor 104 and, hence, the compressor 105 was operated with an A.C. power of a frequency higher than that of the commercial power supply. The air conditioner was operated quietly with a satisfactorily low level of noise.

FIG. 12 shows the relationship between the frequency (KHz) of the noise generated during operation of the rotary compressor and the noise level (dB). The broken-line curve and the solid-line curve in FIG. 12 respectively represent the noise levels in a conventional rotary compressor and a rotary compressor embodying the present invention. It will be seen that the rotary compressor of the invention exhibits a remarkable improvement in the noise reduction particularly at frequencies above 2000 Hz.

The hollow vanes 20 used in the machine of the invention is made from, for example, sintered ferrous alloy. Practically, however, there is a limit in the volume ratio of the interval cavity from the view point of the vane size and strength.

In order to reduce the mass of the vane, it is necessary to use a material which is small in specific gravity but has a high strength. About 20 to 80% reduction in weight of the hollow vane is possible by using, in place of the ferrous material, an aluminum alloy, ceramics material, carbon material or a plastic material.

Although a rotary compressor for use in an air conditioner has been specifically described as an example of the rotary fluid machine with a hollow vane, this is only illustrative and the invention can be applied to other type of rotary fluid machine such as a vane pump. Apparently, the rotary compressor described as an embodiment of the invention can be incorporated in electric household refrigerators and dehumidifiers.

As will be understood from the foregoing description, the invention provides a rotary fluid machine with a hollow vane, in which breakage of the hollow vane and local wear of the vane slot walls are remarkable suppressed to ensure higher reliability of the machine.

In a refrigeration apparatus incorporating such a rotary compressor in combination with an high-speed operation control means such as an inverter, the critical speed at which noise generation due to collision of the vane with the roller starts to occur can be increased to enable the refrigeration apparatus to operate at higher speed with a reduced noise level.

What is claimed is:

1. A rotary fluid machine comprising:

a cylinder block defining a cylinder bore therein;

a rotary piston rotatably disposed in said cylinder bore; and a plate-like hollow vane dividing the space in said cylinder bore into a low-pressure chamber and a high-pressure chamber;

said vane having outer walls at least partially defining at least one cavity of a shape having corners, each corner comprising a curved concave surface of a radius of curvature greater than a thickness of the outer walls of said vane.

2. A rotary fluid machine according to claim 1, wherein said vane is made of a material selected from the group consisting of a ferrous sintered material, an aluminum alloy, a ceramics material, a carbon material and a plastics material.

3. A rotary fluid machine according to claim 1, wherein said vane has an inner end face in sliding engagement with said rotary piston and an outer end face opposite to said inner end face, said cavity being formed by at least one bore which opens only in said outer end face and which has a substantially rectangular cross-section.

4. A rotary fluid machine according to claim 3, further including a spring member resiliently biasing said vane into sliding engagement with said rotary piston, said vane having two major side surfaces, said cavity being formed by at least two bores, said vane further having at least one rib extending between the outer walls of said vane adjacent said two major side surfaces to separate said two bores one from the other, said rib having an outer end adjacent said outer end face of said vane, said outer end of said rib being engaged by and supporting said spring member substantially radially outwardly of said rotary piston.

5. A rotary fluid machine according to claim 4, wherein a recess is formed in said outer end face of said vane to receive an inner end of said spring member and said outer end of said rib is positioned substantially centrally of said recess to support the inner end of said spring member.

6. A rotary fluid machine according to claim 1, wherein said cylinder block has formed therein a vane slot slidably receiving said vane, said vane having two major side surfaces slidable on opposing surfaces of said vane slot and edge surfaces interconnecting said major side surfaces, said outer walls of said vane being formed between said cavity and each of said major side surfaces and between said cavity and each of said edge surfaces of said vane.

7. A rotary fluid machine according to claim 6, wherein said cavity is formed by a plurality of bores having substantially rectangular cross-sections, each adjacent pair of bores being separated by a rib which interconnects the outer walls of said vane adjacent said major side surfaces.

8. A rotary fluid machine comprising:

a cylinder block defining a cylinder bore therein;

a rotary piston rotatably disposed in said cylinder bore; and a plate-like hollow vane dividing the space in said cylinder bore into a low-pressure chamber and a high-pressure chamber;

said vane having outer walls at least partially defining at least one cavity of a shape having corners, each corner comprising a curved concave surface of a radius of curvature greater than a thickness of the outer walls of said vane, said cylinder block having formed therein a vane slot slidably receiving said vane, said vane having two major side surfaces slidable on opposing surfaces of said vane slot, each of said major side surfaces of said vane having a surface layer formed of an oxide film consisting mainly of tri-iron tetraoxide ($Fe_3O_4$), said oxide film having a surface finished by smoothing processing.

9. A rotary fluid machine according to claim 8, wherein said vane is made of a ferrous sintered material.

10. A refrigeration apparatus comprising:

an electric motor;

compressing means driven by said electric motor; and control means including an inverter and capable of operating the electric motor with a power of a frequency higher than that of a commercial power supply;

said compressing means including a cylinder block defining a cylinder bore therein; a rotary piston rotatably disposed in said cylinder bore; and a plate-like hollow vane dividing the space in said cylinder bore into a low-pressure chamber and a high-pressure chamber; said vane having outer walls at least partially defining at least one cavity of a shape having corners, each corner comprising a curved concave surface of a radius of curvature greater than a thicknesses of the outer walls of said vane.

11. A refrigeration apparatus comprising:

an electric motor;

compressing means driven by said electric motor;

said compressing means including a cylinder block defining a cylinder bore therein; a rotary piston rotatably disposed in said cylinder bore; and a plate-like hollow vane dividing the space in said cylinder bore into a low-pressure chamber and a high-pressure chamber; and vane having outer walls at least partially defining at least one cavity of a shape having corners, each corner comprising curved concave surface of a radius of curvature greater than a thicknesses of the outer walls of said vane.

* * * * *